US005515980A

United States Patent [19]

Fotioo

[11] Patent Number: 5,515,980

[45] **Date of Patent: *May 14, 1996**

[54] DIMENSIONALLY VARIABLE HANGING FILE FRAME SYSTEM

[75] Inventor: Bobby Fotioo, Helena, Ark.

[73] Assignee: B & L Products, Inc., Hot Springs, Ark.

[ * ] Notice: The term of this patent shall not extend beyond the expiration date of Pat. No. 5,405,020.

[21] Appl. No.: 345,239

[22] Filed: Nov. 28, 1994

Related U.S. Application Data

[63] Continuation-in-part of Ser. No. 172,063, Dec. 23, 1993, Pat. No. 5,405,020.

[51] Int. Cl.[6] ..... A47F 5/00

[52] U.S. Cl. ..... 211/46; 211/189; 312/184

[58] Field of Search ..... 211/182, 189, 211/46, 162; 312/184

[56] References Cited

U.S. PATENT DOCUMENTS

| | | | |
|---|---|---|---|
| 3,999,663 | 12/1976 | Walter | 211/175 |
| 4,030,610 | 6/1977 | Alexander | 211/182 |
| 4,049,127 | 9/1977 | Alexander | 211/189 |
| 4,091,933 | 5/1978 | Alexander | 211/204 |
| 4,176,753 | 12/1979 | Godfrey | 211/182 |
| 4,236,770 | 12/1980 | Moore et al. | 312/184 |
| 4,295,571 | 10/1981 | Meyer | 211/200 |
| 4,526,277 | 7/1985 | Snowden et al. | 211/46 |
| 4,726,635 | 2/1988 | Rariden et al. | 312/184 |
| 5,205,626 | 4/1993 | Fotioo | 312/184 |
| 5,405,020 | 4/1995 | Fotioo | 211/189 X |

*Primary Examiner*—Robert W. Gibson, Jr.

*Attorney, Agent, or Firm*—Stephen D. Carver; Trent C. Keisling

[57] ABSTRACT

A variable dimension hanging file frame system is equipped with adjustable corners permitting installation in either letter-sized or legal sized drawers. The system comprises two side rails, two cross member rods and two hoops joined by adjustable corners. The side rails slidably receive the corners and are longitudinally adjustable to alter the file containment area formed by the frame interior. The corners comprise a generally rectangular body and a slider that are slidably coupled together to vary the width of the frame interior. The slider receives the side rail and the body receives the rods and hoops. The body comprises a slot and a first pair of minor bosses that are horizontal and parallel to one another. The minor bosses receive the rod end portions and may alternatively receive barbed hoop ends. Preferably, a third minor boss is defined vertically to receive the hoop ends. The slot has a generally rectangular cross section and receives the slider. The slider comprises an arm having a generally rectangular cross section. An elongated major boss integrally formed on one end of the arm temporarily secures a penetrating side rail. A shoulder bordering the major boss acts as a stop when the slider is fully retracted and the shoulder contacts the body. The distal end of the arm is slightly enlarged to wedgably retard movement of the slider at the extended extreme.

15 Claims, 9 Drawing Sheets

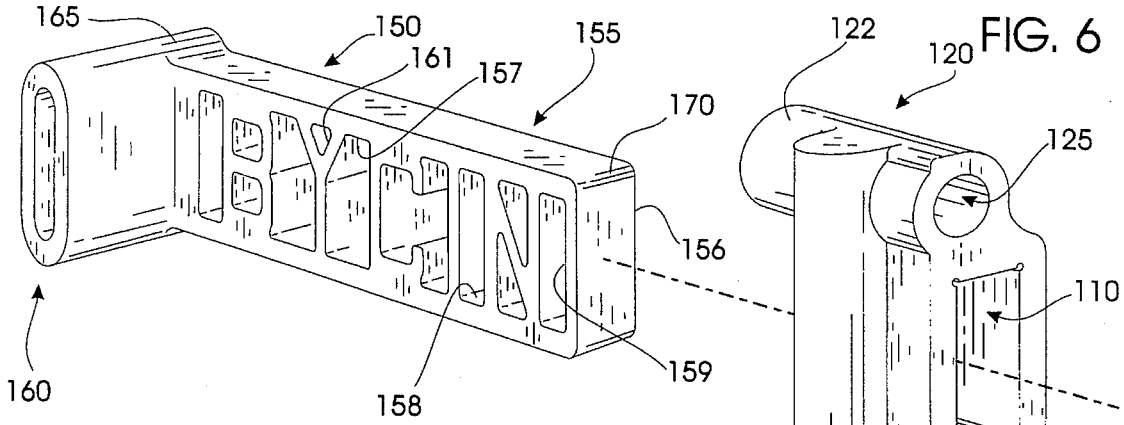
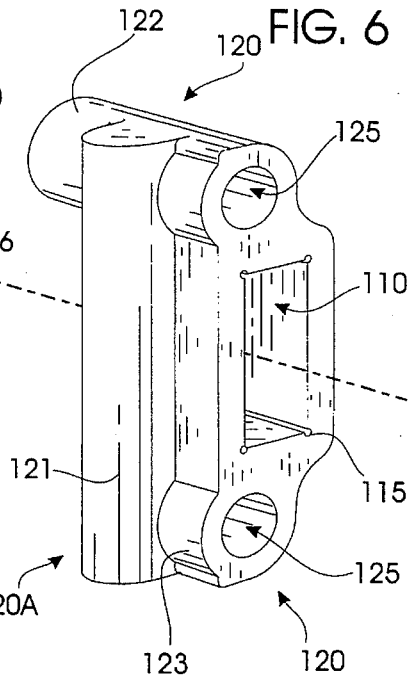
FIG. 6
FIG. 7
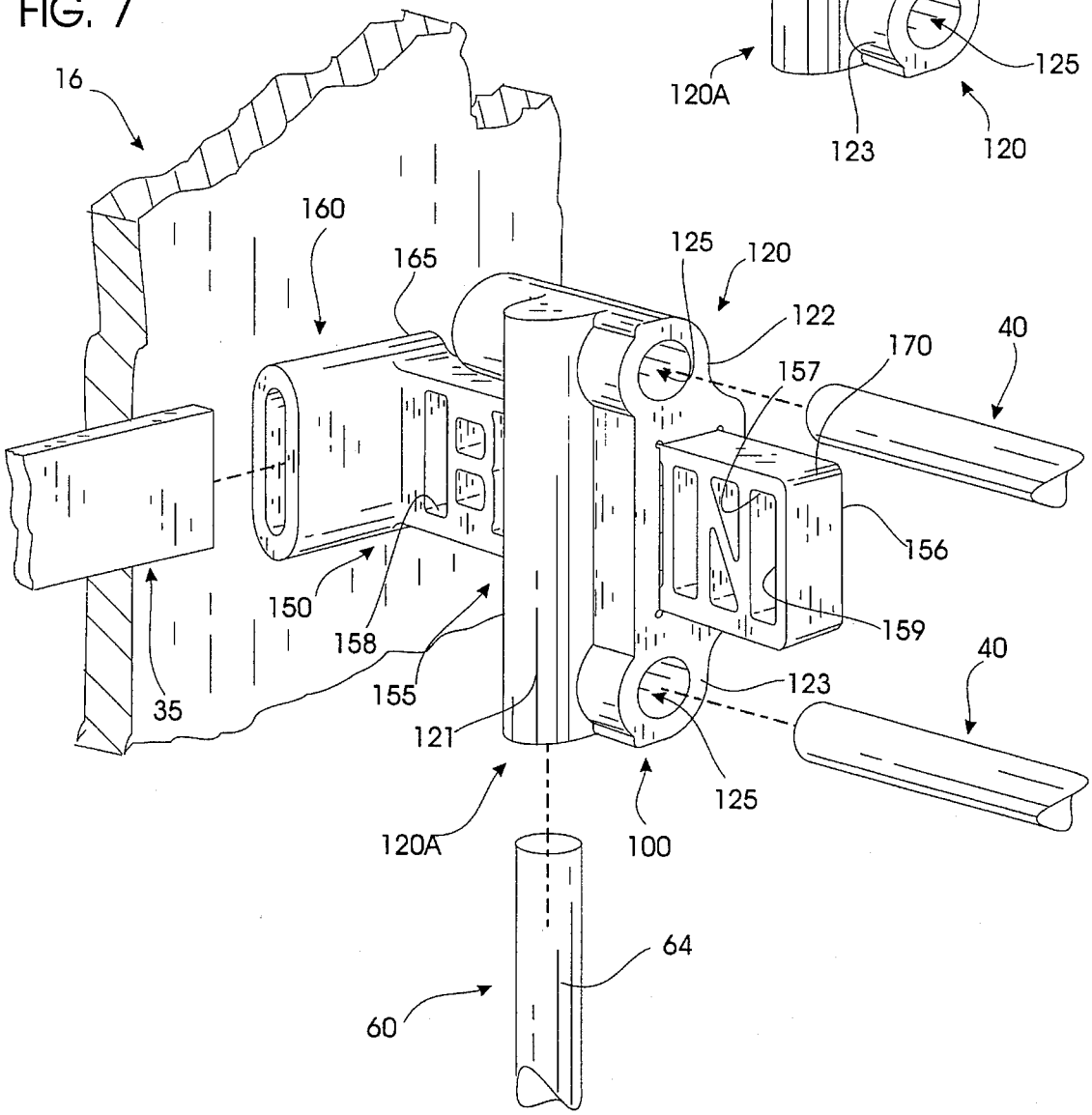

DIMENSIONALLY VARIABLE HANGING FILE FRAME SYSTEM

CROSS-REFERENCE TO RELATED APPLICATION

This is a Continuation-in-Part of prior patent application Ser. No. 08/172,063, filed Dec. 23, 1993, entitled: Adjustable Hanging File Frame System, now U.S. Pat. No. 5,405,020, issued Apr. 11, 1995, the contents of which are incorporated herein.

BACKGROUND OF THE INVENTION

1. Field of the Invention

The present invention broadly relates to hanging file systems for desk drawers or the like. More particularly, it relates to an improved hanging file system employing extensible corner joints for holding a variety of hanging file sizes in filing drawers. The field of the invention includes U.S. Classes 211, Subclasses 182, 183, 191, 204, 206 and Class 312, Subclass 184.

2. Description of the Prior Art

Hanging file folder frames are well known in the art. A variety of configurations exist. Such frames may be integrated into original equipment drawers, or they may be retrofitted to existing equipment.

Bojarn, U.S. Pat. No. 3,788,718 discloses a rigid frame with slip button type connectors for attaching the sides and the ends together. It is constructed of plastic and is of fixed dimensions.

Barber, U.S. Pat. No. 4,312,453 discloses a file hanging system employing two "U" shaped brackets and "U" shaped groves in which the brackets travel.

Broek, U.S. Pat. No. 4,658,966 discloses a hanging file system for blueprints and such. It comprises a frame to be attached to the blueprint and wall brackets mounting a rod that mates with the frame.

U.S. Pat. No. 4,726,635 issued to Rariden for a hanging file folder support assembly is comprised of bars to be disposed in drawers at right angles to one another. The side bars of this system are secured within the drawer. Goedken, U.S. Pat. No. 4,887,873, discloses a file system with rails having a camming surface at their forward end to engage a slot on the inside surface of the front wall of the file drawer. The rail further extends rearward and has a downward extending leg.

U.S. Pat. No. 3,944,080, issued to Hansen Mar. 16, 1976, discloses a structure for supporting hanging file folders. The structure includes a pair of side rail wire members attached to solid plates that are attached or formed from the ends of the file drawer.

U.S. Pat. No. 4,236,770, issued to Moore Dec. 2, 1980, discloses a device to be inserted on the ends of hanging file folders to allow them to slide more easily along the bars of the systems such as those disclosed in the above patents.

Some of the rigid systems disclosed in the above mentioned patents require special slots or holes in the drawers. While these systems can support substantial weight, they are not removable.

Other patents disclose hanging file frames that are more self contained and which provide a more flexible structure. Alexander, U.S. Pat. No. 4,049,127, discloses a frame that is primarily comprised of side rails, cross-members and a pair of legs. The rails are joined to the cross-members and the legs by corner fittings. The corner fittings in this patent are "U" shaped allowing the side rails to slide forward and rearward through the fittings. U.S. Pat. No. 4,030,610, also issued to Alexander, discloses a structure fairly similar to his previous cited patent. The hanging file frame includes rails, two cross-members and four downward extending legs. The components are joined at each corner by corner fitting of strong plastic. These corner fittings allow the side rails to slide forward and rearward while holding the legs and the cross-members rigid.

Godfrey, U.S. Pat. No. 4,176,753 discloses a hanging file support frame once again with two side rails, two cross-members, and two downward extending leg assemblies. These components are joined by four corner fittings that also allow the side rails to slide forward and rearward and which allow the side rails to be inserted in the bracket through the outer face of the bracket. The cross members in this structure are hollow.

Alexander, U.S. Pat. No. 4,091,933 discloses a hanging file system having two end legs, two cross-members, side rails, and four corner supports. The legs and the cross members enter the corner supports at right angles to one another while the side rails are constructed in such a manner that they mate with the outer surfaces of the corner supports. The corner supports have biased hooked portions formed in their outer surface that slide the rails upon the fittings from front to rear.

Snowden, U.S. Pat. No. 4,526,277 discloses a hanging file frame employing legs joined by cross-pieces or feet. My earlier issued U.S. Pat. No. 5,205,626 discloses a hanging file system having two side rails, two cross member rods and two hoops joined together by four modular joint supports. Two sizes of corner joint supports are disclosed to adapt the system to receive either letter or legal files.

Walter, U.S. Pat. No. 3,999,663, discloses a frame for suspended file folders that employs extensible cross members. the cross-members have center slides to convert the width of the frame. Meyer, U.S. Pat. No. 4,295,571, discloses a file folder support rack that has scissor type ends which allow adjustment of the width of the rack. The inventors of each of these systems recognized the need for a hanging file frame that can accommodate a variety of hanging file sizes. Letter or legal file frame may not accommodate paper sizes such as "A-4" or other international or foreign standards.

The prior art fails to disclose a hanging file system which is convertible from a legal to letter configuration without the replacement of several components. Adjustable file frames that can accommodate intermediate sizes use relatively complicated or unstable adjustment systems. Hanging file systems often lack stability and rigidity. Either makes the handling of heavy files difficult for the frame to structurally sustain.

Hence, it is desirous to provide an easy to use stable hanging file system that can convert to accommodate a variety of hanging file dimensions. This system should incorporate the design features and advantages of my patented hanging file system such as structurally stronger corner joints and support legs that may flex to rest against the end corners of the file drawer. In other words, the corner joint construction should remain resilient while offering the ability to control the width of the frame. Therefore, it is desirous to provide a corner joint that is slidably adjustable between letter and legal sizes, allowing intermediate deployment to accommodate international and foreign standards.

Another desirable advantage would be the ability of the frame system to be longitudinally adjusted to compressively secure the files for storage and transportation or another reason. Often, especially when files are initially installed, the files are not full and do not occupy the entire drawer or enclosure area in which they are contained. The prior art fails to address this problem adequately. Thus, it would be desirable to provide a frame system that longitudinally expands or contracts to prevent longitudinal movement of the files inside the frame.

SUMMARY OF THE INVENTION

My Longitudinally Adjustable Hanging File Frame System allows a file frame constructed of a plurality of orthogonally interconnected frame members to be adjusted between letter, legal and intermediate file sizes. It also permits the longitudinal alteration or adjustment of the file containment area defined by the frame system. The corners are a two piece part, constructed from a resilient material such as plastic (i.e., nylon). The frame is supplied to the consumer in kit form and can be deployed by the user without special tools. Due to the nature of the corner support, the system is adaptable to drawers of different sizes.

The frame comprises two side rails, one or two pairs of cross member rods and two downwardly projecting hoops joined together by four corners to define an adjustable file containment area. The corners comprise two pieces, a slider and a body, that are slidably mated together. The slider yieldably secures the side rail, permitting longitudinal adjustments of the file containment area defined thereby. The body secures the rod and hoop. The two pieces move relative to one another, allowing the rails to be displaced perpendicularly relative to the rod and hoop. Thus, the width of the frame can be adjusted.

A body portion mated to the rod and hoop comprises an internal slot and three minor bosses integrally defined in the body. Two of the minor bosses are formed on each end. These bosses are aligned and parallel. Their open ends are exposed along a common edge of the body. The third minor boss depends vertically opposite the internal slot. The first pair of minor bosses receive end portions of the rods. Alternatively, the hoops may be secured in the one of the first pair of minor bosses, replacing a rod in the frame assembly. Preferably, the hoops are secured in the third, downwardly opening minor boss. The slot defined in the body has a generally rectangular cross section to receive the slider.

The slider is the second component of the corner. The slider comprises an arm having a generally rectangular cross section. The arm is slidably received in the slot. The slider further comprises an elongated major boss integrally formed on one end of the arm. The major boss receives an end of the side rail. The major boss forms a channel through which the side rail may be adjustably displaced to change the file containment area. Due to their mated shapes, the arm and the slot maintain the major boss generally perpendicular to the first pair of minor bosses. Hence, the rail is maintained generally perpendicular to the hoop and rods. A shoulder is defined adjacent to the major boss to act as a stop when the slider is fully retracted and the major boss is in close proximity with the body. The distal end of the arm, relative to the major boss, is slightly enlarged. Therefore, as the slider moves within the slot, the distal end will wedgably retard movement of the slider near its full extension.

In the best mode, the side rails are made of relatively flat stock with a plurality of notches defined in one end. The notches facilitate initial adjustments to frame length. When the frame is initially installed, the rails are shortened by breaking away a portion of the side rail with a pair of pliers. The longitudinal length of the frame may be selectively altered by sliding the corners along the side rails to expand or contract the file containment area defined by the frame.

The cross members and the hoops are preferably formed from round bar stock of the same diameter. The cross members are pieces of round bar stock of a predetermined length. The hoops are each bent from a single piece of stock forming a foot section, upright, and integral legs at either end of the foot section. In one embodiment, the legs terminate in outwardly turned, horizontal tangs adapted to be disposed parallel with the cross members.

When the frame is deployed, the major bosses can contact the side wall of the drawer in which the system is placed, spacing the rail away from the wall. This will prevent interference between the wall and the hanging files. In operation the sliders will move from a fully retracted position wherein the stops contact the corner body to a fully extended position wherein the enlarged end of the arm wedgably engages the slot and the body to retard further outward travel.

Thus a broad object of the present invention is to provide an easily extendible and contractible corner for hanging file frames.

A related object of the present invention is to provide an easy to adjust hanging file suspension frame for desk drawers.

Another basic object is to provide a frame corner of the character described that will allow a file frame to be user-configured for desk drawers of different sizes.

A still further object is to provide a corner that is stable and relatively rigid.

A related object is to provide a hanging file frame that, once adjusted to the proper width, is stable.

A related object is to provide a hanging file frame that will longitudinally adjust in size to change the file containment area defined by the frame.

A further object is to provide a corner that will allow adjustment of the frame width without jamming and binding.

A related object is to provide a frame of the character described that stays in alignment, and avoids jamming and binding and prevents movement of the files.

Another object is to provide a hanging file folder suspension frame that will not fall apart when removed from a drawer.

Another basic object is to provide a hanging file frame that facilitates longitudinal adjustment of the file containment area defined by the frame.

A similar object is to provide a corner that prevents the support elements from dropping out or becoming separated when the frame is lifted from the file drawer, so that the frame may be removed from the drawer without first removing all the files.

A similar object is to provide a hanging file folder suspension frame that can be moved from one drawer to another drawer and adjusted for use therein.

A related object of the present invention is to provide a corner that wedgably binds prior to allowing separation of the frame components.

A still further object is to allow the frame to flex somewhat without collapsing.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 6 is a greatly enlarged, isometric view of the corner illustrating mating of the arm and slot and the relative positions of the minor and major bosses;

FIG. 7 is an enlarged, fragmentary exploded interior isometric view of the frame, illustrating deployment of my corner relative to the wall of a drawer;

DETAILED DESCRIPTION

Figure 1:
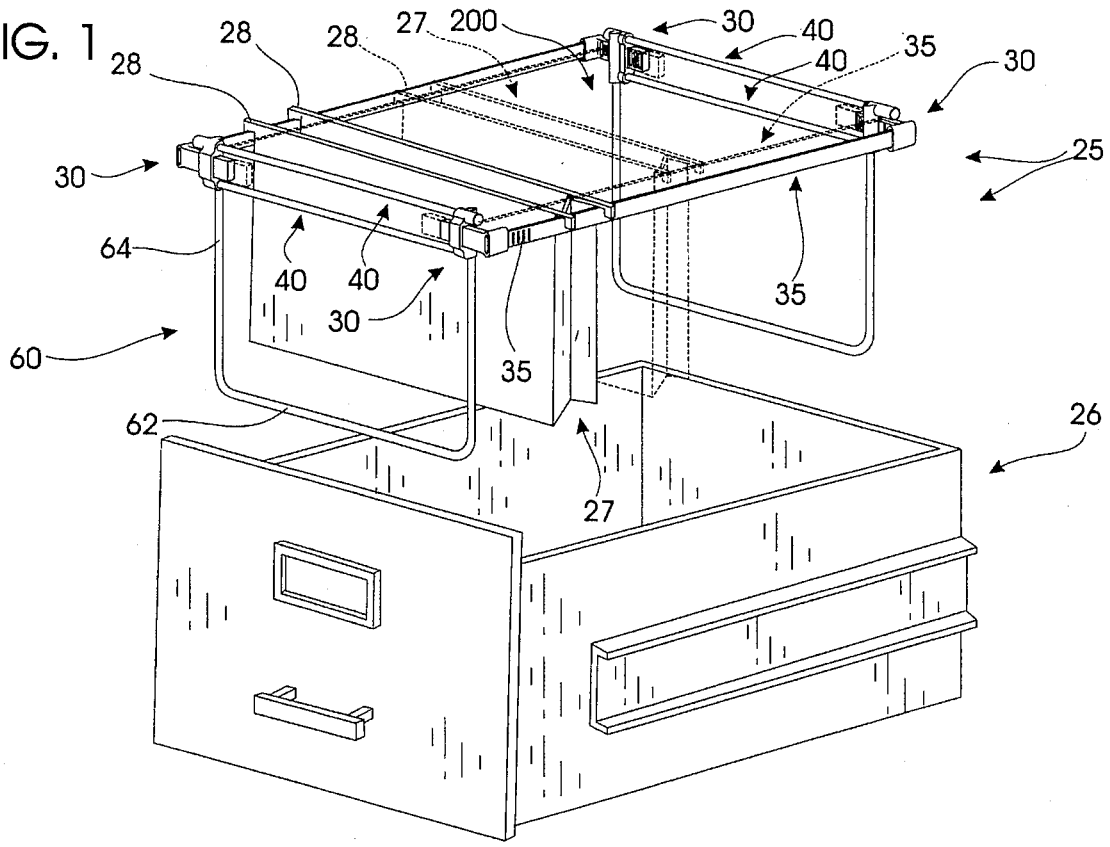
FIG. 1 is a partially exploded, environmental view illustrating a filing frame system employing my adjustable corners, with a moved position shown in dashed lines.

With reference now to the accompanying drawings, a file frame system constructed in accordance with the best mode of my invention is broadly designated by the reference numeral 25. The illustrated frame system 25 may be fitted together from a kit and inserted into a conventional cabinet or desk drawer 26 and adjusted to the appropriate dimensions. The file frame system 25 defines a longitudinal and width variable file containment area 200. The frame 25 supports a plurality of conventional hanging file folders 27, whose hooked ends 28 slidably engage the upper sides of the framework. It should be understood that frame 25 may be adapted for use with drawers of different sizes including letter, legal and international sizes by extending the corners 30 of the frame 25.

Figure 2:
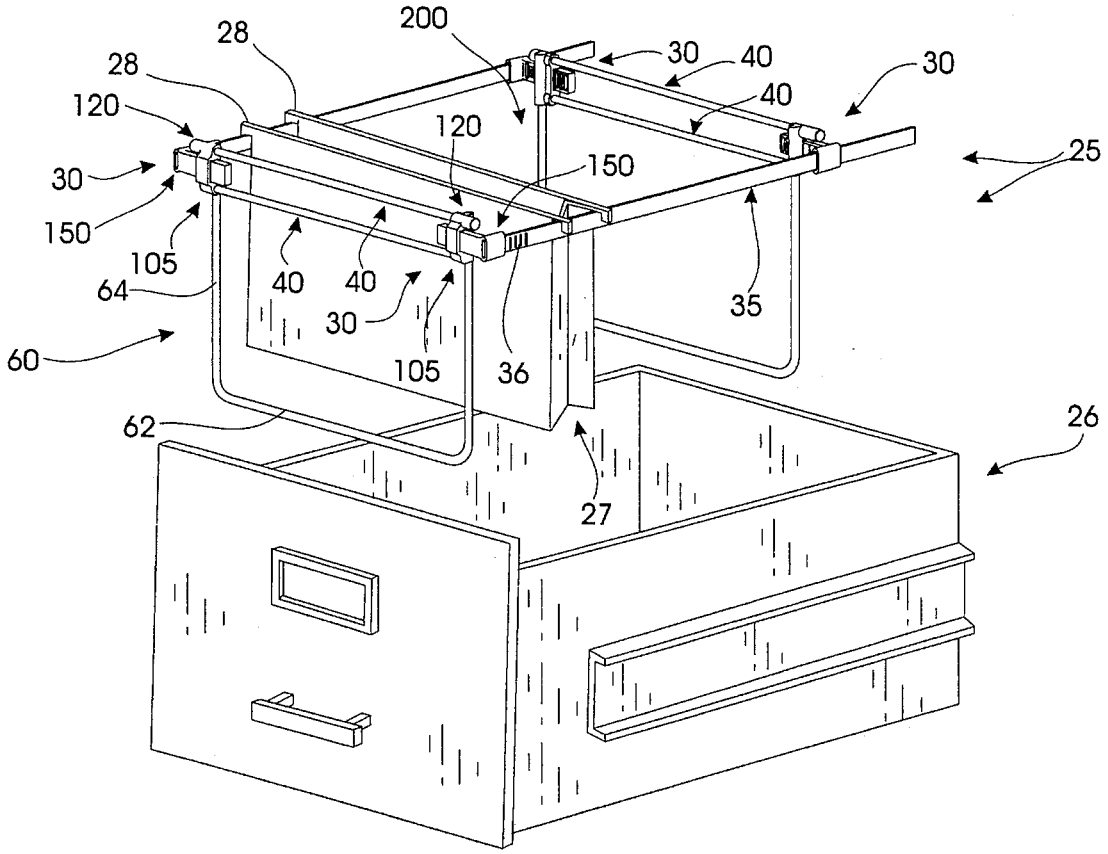
FIG. 2 is a partially exploded, environmental view similar to FIG. 1, illustrating a filing frame system employing my adjustable corners, showing a longitudinal displacement to reduce the file containment area.
Figure 3:
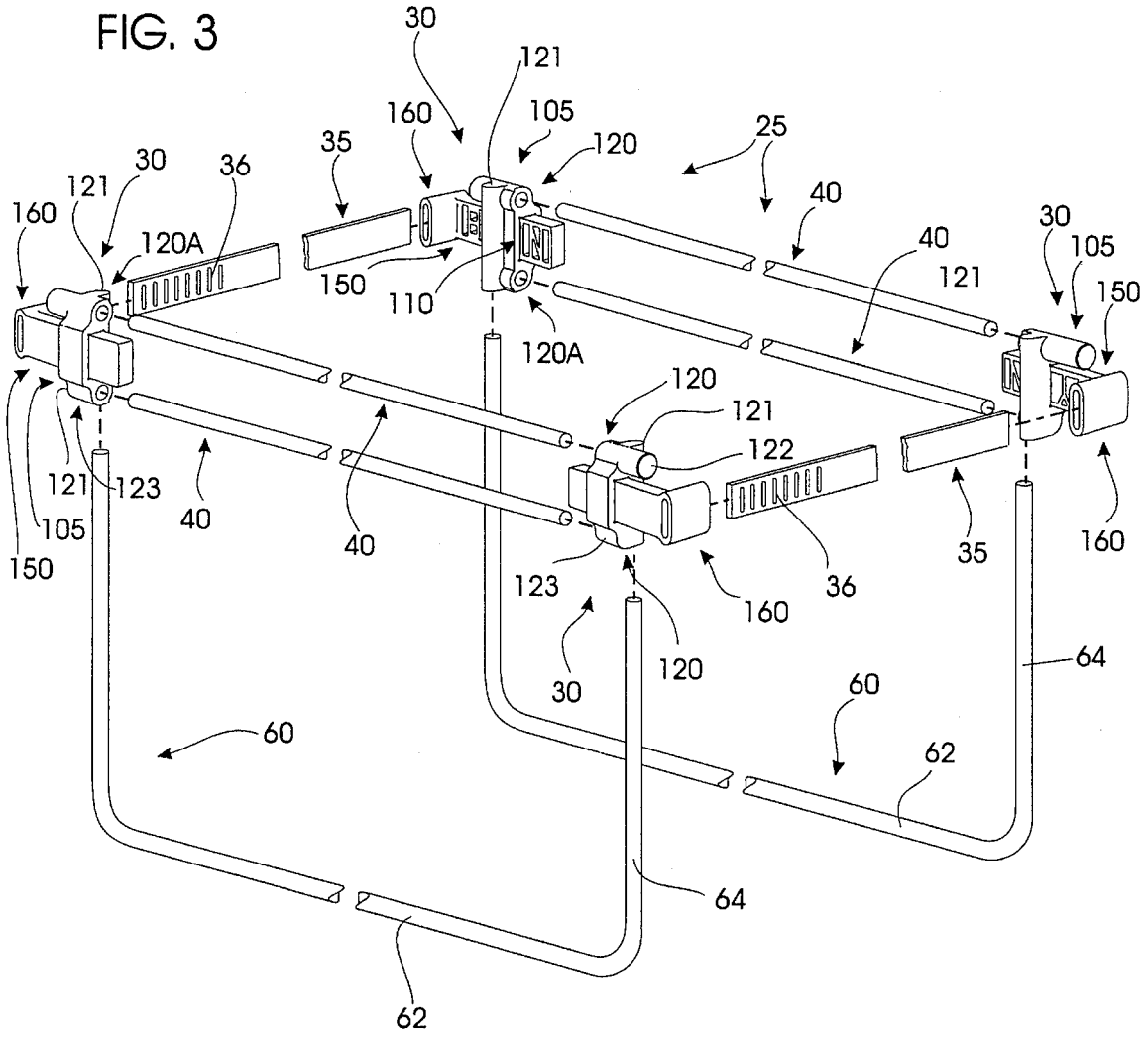
FIG. 3 is an enlarged, fragmentary, exploded, isometric view of a filing frame employing my corners, with the corners disposed in a partially extended position.
Figure 4:
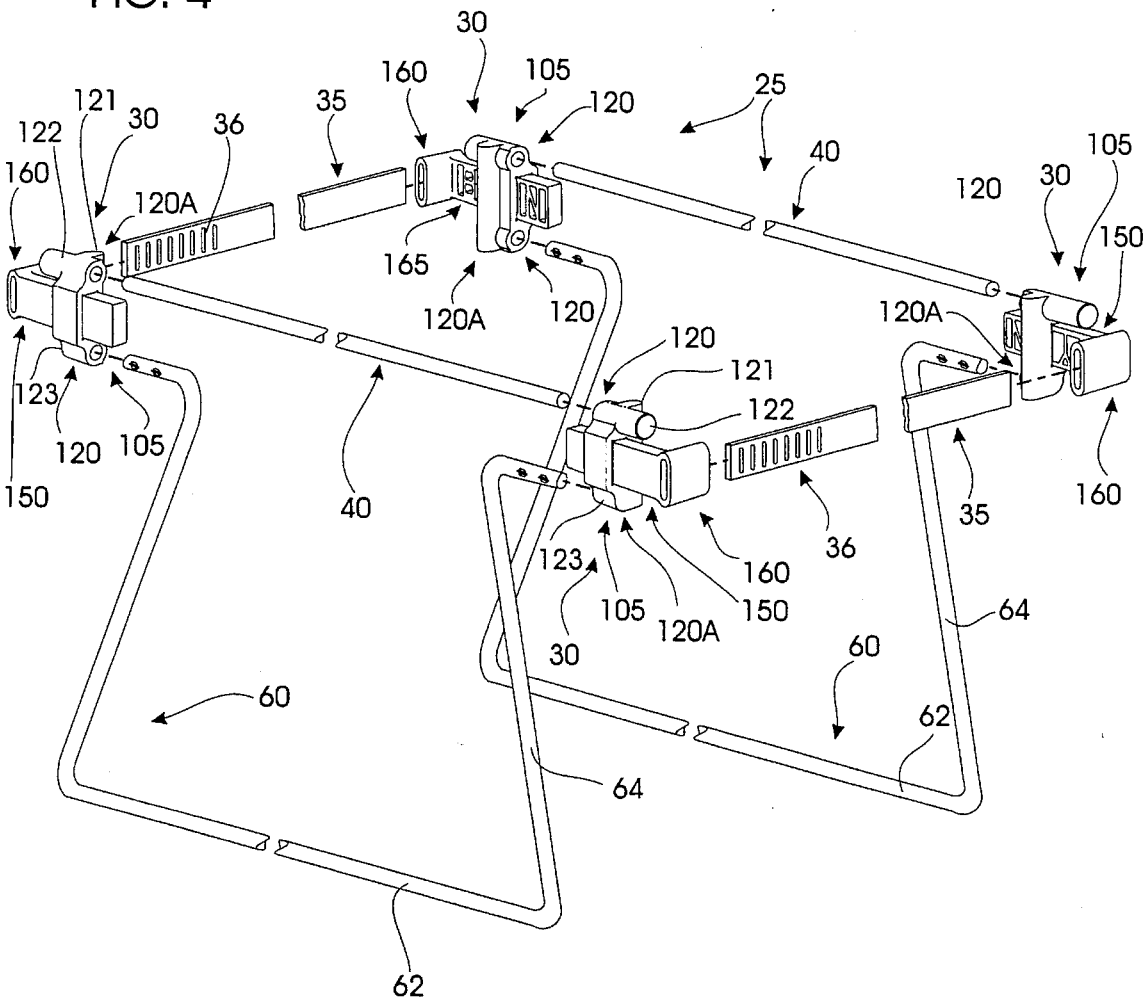
FIG. 4 is an enlarged, fragmentary, exploded, isometric view similar to FIG. 3, showing an alternative embodiment of my invention and having a filing frame employing my corners, with the corners disposed in a partially extended position.
Figure 5:
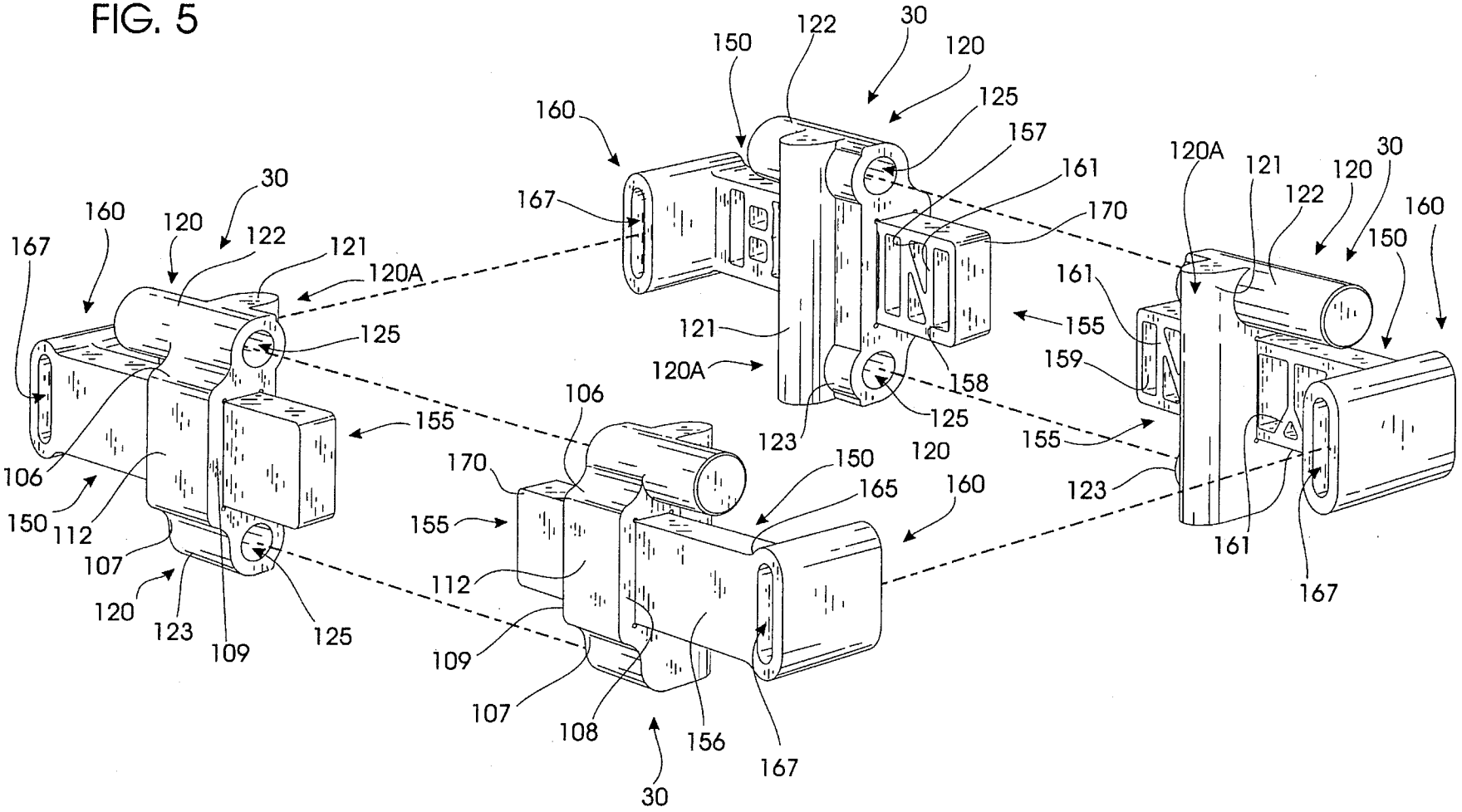
FIG. 5 is a greatly enlarged, fragmentary, exploded, isometric view showing several of my adjustable corners in a spatial relationship.
Figure 8:
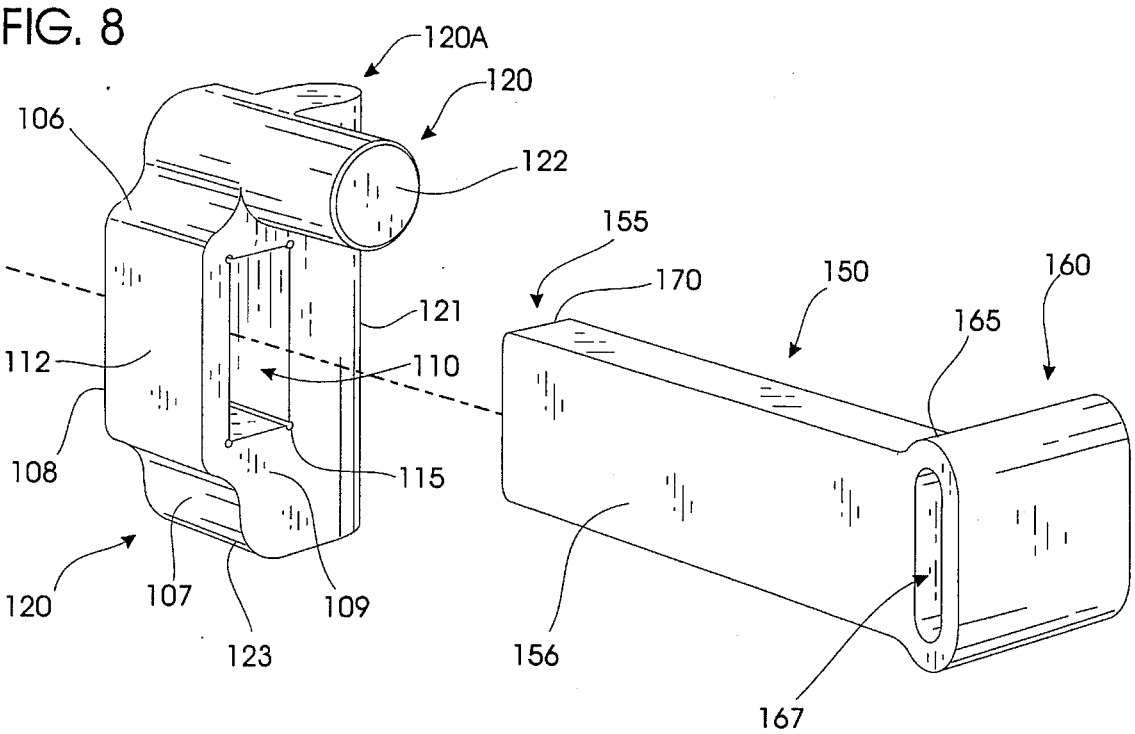
FIG. 8 is a greatly enlarged, isometric view of the corner as it appears generally to the rear of FIG. 7.
Figure 9:
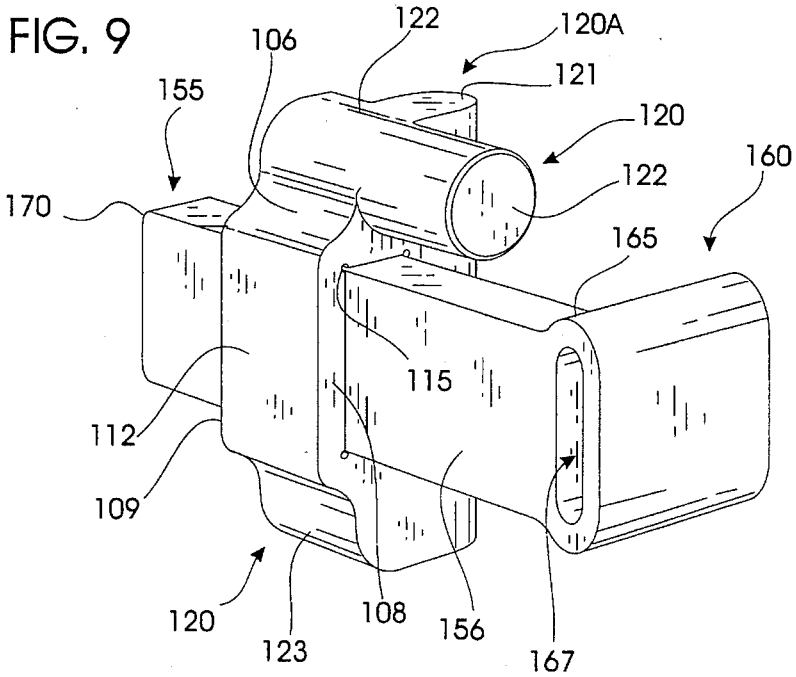
FIG. 9 is a greatly enlarged, isometric view of the corner as it appears generally to the rear of FIG. 8, illustrating the arm received in the slot and the relative positions of the minor and major bosses.
Figure 10:
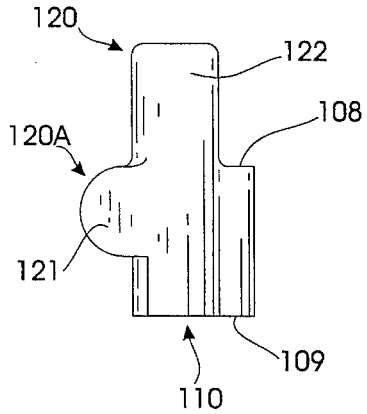
FIG. 10 is a greatly enlarged, fragmentary, top plan view of a portion of the corner shown in FIGS. 8 and 9, with the arm omitted for clarity.
Figure 11:
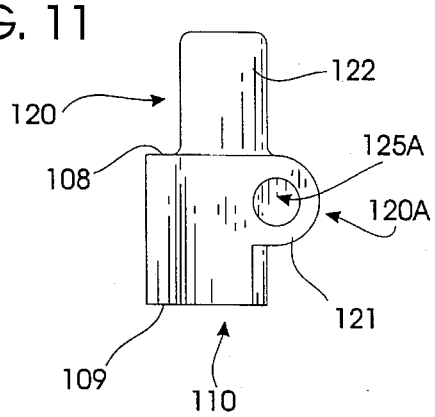
FIG. 11 is a greatly enlarged, fragmentary, bottom plan view similar to FIG. 10.
Figure 12:
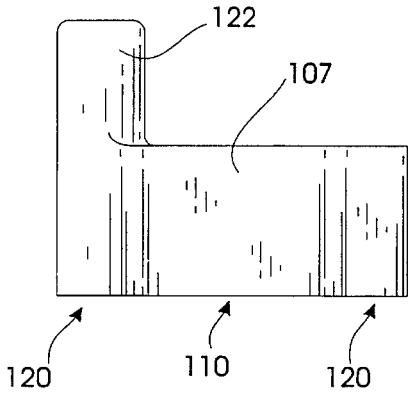
FIG. 12 is a greatly enlarged, fragmentary, front elevational view of a portion of the corner shown in FIG. 9, with the arm omitted for clarity.
Figure 13:
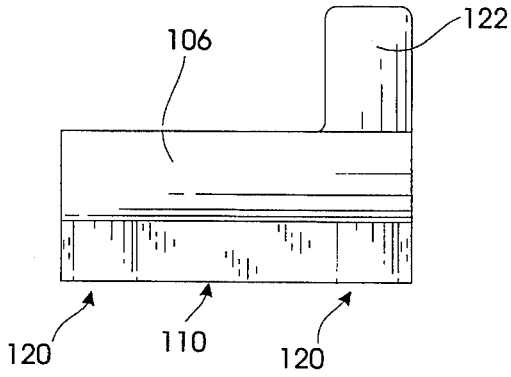
FIG. 13 is a greatly enlarged, fragmentary, rear elevational view similar to FIG. 12.
Figure 14:
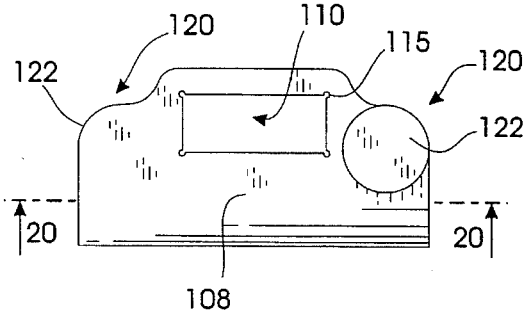
FIG. 14 is a greatly enlarged, fragmentary, right elevational view similar to FIG. 12.
Figure 15:
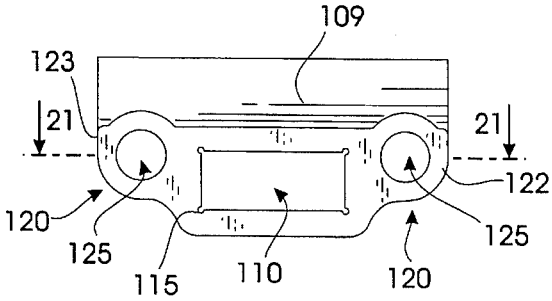
FIG. 15 is a greatly enlarged, fragmentary, left elevational view similar to FIG. 12.
Figure 16:
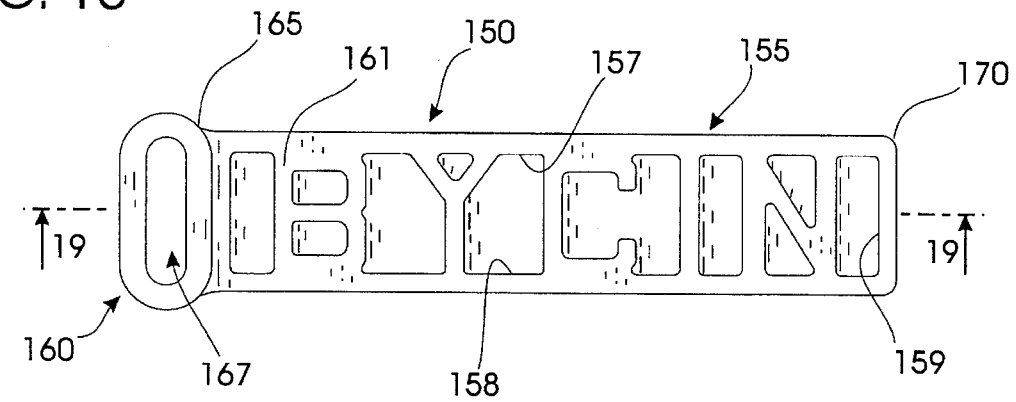
FIG. 16 is a greatly enlarged, fragmentary, front elevational view of a portion of the corner shown in FIG. 7, with the body omitted for clarity.
Figure 17:
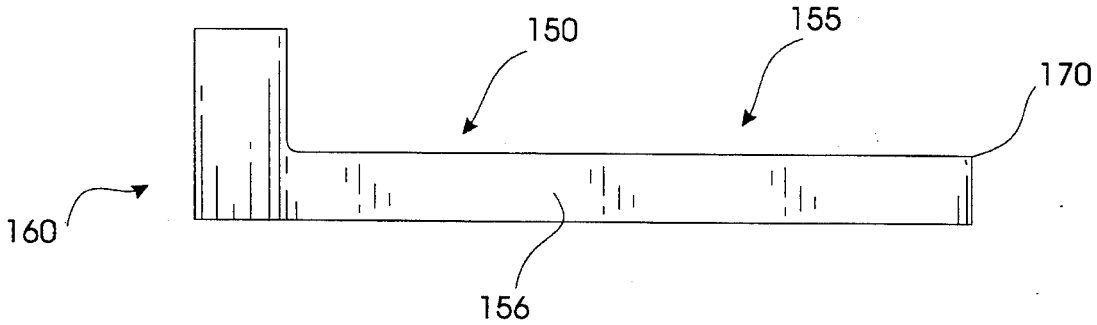
FIG. 17 is a greatly enlarged, fragmentary, top plan view similar to FIG. 16.
Figure 18:
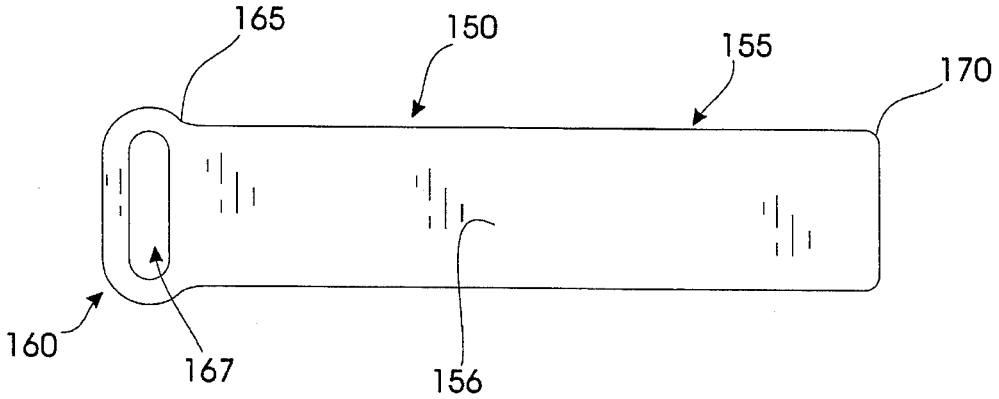
FIG. 18 is a greatly enlarged, fragmentary, rear elevational view similar to FIG. 16.
Figure 19:
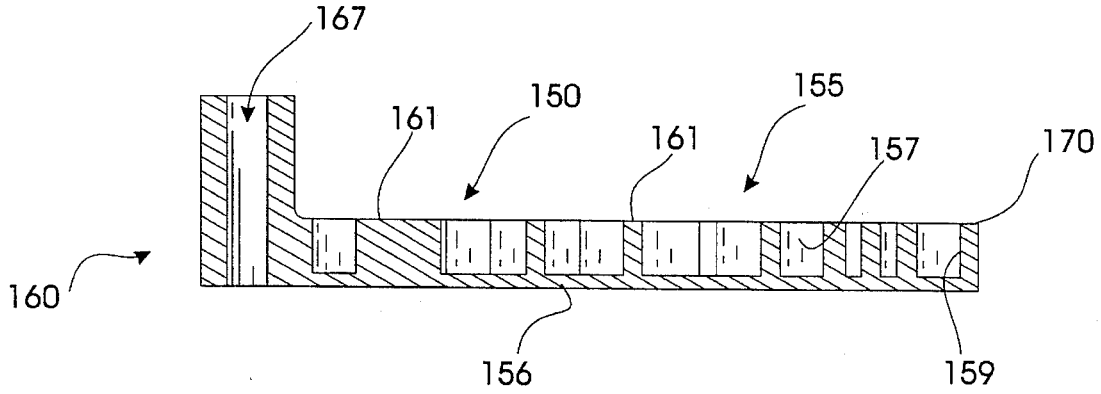
FIG. 19 is a greatly enlarged, cross-sectional view taken along line 19—19 of FIG. 16.
Figure 20:
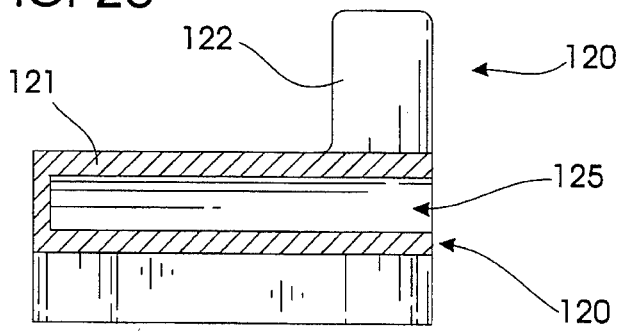
FIG. 20 is a greatly enlarged, cross-sectional view taken along line 20—20 of FIG. 14; and, FIG. 21 is a greatly enlarged, cross-sectional view taken along line 21—21 of FIG. 15.
Figure 21:
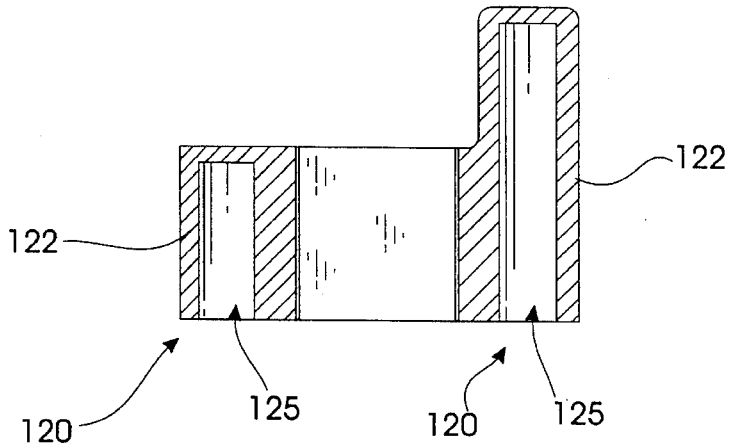

With reference to FIGS. 1 and 2, the preferred hanging file frame system 25 comprises two elongated, spaced apart and parallel side rails 35 forming upper sides of the system. Preferably two pairs of cross member rods 40 extend in parallel, spaced apart relation to one another perpendicularly between the rails. In an alternative embodiment, only one pair of cross member rods 40 is used. The frame 25 is supported by a hoop 60 at each end. Four adjustable corners 30 form the vertices of the generally cubical frame system. As seen in FIGS. 1 and 2 the elongated side rails 35 are joined to the cross member rods 40 and the hoops 60 by the corners 30 and the corners may be adjusted to provide the desired spacing between the rails 35.

The elongated side rails 35 are made of relatively flat stock with a plurality of scores 36 near one end. These scores 36 allow the side rail length to be adjusted as necessary for a particular application. A portion of the side rail 35 is broken away employing conventional pliers or the excess portion is extended through the corners 30.

The cross member rods 40 and the hoops 60 are formed from round bar stock of the same diameter. The cross member rods 40 are pieces of round bar stock of a predetermined length. The hoops 60 as illustrated in FIGS. 1 and 2, are each bent from a single piece of stock. The hoops comprise a foot section 62, upright, and integral legs 64 at either end of the foot section 62. The legs 64 are inserted into two of the corners 30.

The two-piece corners 30 are preferably constructed of a resilient but somewhat flexible plastic. One piece, the slider 150 is penetrated by one side rail 35, and the other piece, the body 105, secures the rod 40 and hoop 60. The two pieces slide relative to one another, allowing the rails 35 to be displaced longitudinally and perpendicularly relative to the rods 40 and hoops 60. Therefore, the width of the frame 25 can be adjusted as shown in FIGS. 1 and 2.

The portion of the corner 30 mated to the rod 40 and hoop 60 is a generally rectangular body 105 comprising a slot 110 and minor bosses 120, 120A integrally formed on each end. The body 105 comprises two ends 106 and 107 and two edges 108 and 109, perpendicular to the ends 106 and 107. A planar surface 112 is defined by the ends 106 and 107 and the edges 108 and 109. A vertically positioned minor boss 121 is formed opposite the planar surface 112. Minor boss 121 captivates the hoop foot 64 to support the frame 25. A pair of horizontally positioned minor bosses 122, 123 are formed on the ends 106 and 107. These horizontal minor bosses 120 receive end portions of the rods 40. Only one end 125 of the minor bosses 120 is open, the other end is preferably closed. The open end 125, 125A of each minor boss 120, 120A is exposed along a common edge 109 or 107 of the body 105. The minor bosses 122, 123 are aligned and parallel. The bosses 122, 123 are oriented horizontally whenever the hanging file frame system 25 is assembled. Bosses 120, 120A have a bore diameter approximating the diameter of the smooth bar stock forming the cross member rods 40 and the hoops 60. This torsionally locks the rods 40 and hoops 60 in place. The slot 110 defined in the body 105 has a generally rectangular cross section that receives a slider 150. Four air channels 115 located in each corner of slot 110 facilitate the sliding action of the slider 150.

The slider 150 is the second component of the corner 20. The slider 150 comprises an arm 155 with a generally rectangular cross section. Preferably, the arm 155 has a base 156 and vertically oriented side walls 157, 158. An end wall 159 spans the end of the side walls 157, 158 perpendicular to the floor 156. The top of the arm is open. Reinforcement lettering 161 extend between each wall 157, 158 and 159 and the floor 156. The arm 155 is slidably received in the slot 110. The slider 150 further comprises an elongated major boss 160 integrally formed on the end of the arm 155 opposite the end wall 159. The major boss 160 defines a channel 167 that receives a portion of the side rail 35. The side rail 35 may be moved longitudinally to alter the interior, file containment area 200 defined by the frame. A channel 167 penetrates the major boss 160 to facilitate the movement of the side rail 35. Due to their interlocked shapes, the arm 155 and the slot 110 maintain the major boss 160 generally perpendicular to the minor bosses 120. Hence, the rails 35 remain generally perpendicular to the hoops 60 and rods 40.

A shoulder 165 is defined adjacent the major boss 160 to act as a stop when the slider 150 is fully retracted. The shoulder 165 contacts edge 109 of the body 105 when the major boss 160 nests between the minor bosses 120. The distal end 170 of the arm 155, relative to the major boss 160, is slightly enlarged, in the area of the end wall 159. Therefore, as the slider 155 moves within the slot 110 in the body 105, the distal end 170 wedgably engages the slot retarding movement of the slider 150.

When deployed the major boss 160 can contact the side wall 200 of the drawer 26 in which the frame 25 is placed. This will prevent the rails from binding against the wall 200 of the drawer 26. In operation, when the slider 150 is fully retracted the shoulder 165 contact the corner body 105. When fully extended, the enlarged end 170 of the arm 150 wedgably engages the slot 105 retarding further outward travel.

ASSEMBLY AND OPERATION

To assemble a frame employing my adjustable system the inside length of the file drawer is measured first. Then the side rails are shortened by breaking away the excess length with a pair of pliers. Next, the corner joints are assembled. Next, the tang 68 of a hoop 60 is inserted into a minor boss 120 in a corner 30, a cross member 40 is inserted into the other minor boss 120 and a side rail 35 into the major boss 160. The process is repeated for each corner. The frame 25 is then placed within a file drawer.

The width is adjusted to accommodate the drawer and hanging files by sliding the rails 35 outward as necessary. Numerous file folders may be then inserted, with their hook portions 28 (FIG. 1) able to freely slide along the rails. The side rails may be adjusted longitudinally to alter or adjust the file containment area 200 as desired.

Since the hoops 60 are tensioned in the minor bosses 120A, they will not rotate or withdraw. Sagging is discouraged and the foot 62 may be placed in the rear corner of the drawer. The frame's orientation will be preserved even if it is removed from the drawer with several hanging file folders stacked upon it. Furthermore, the inherent elastic nature of the round bar stock of the hoops 60 will allow the frame 25 to flex without complete collapse.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. An adjustable corner for hanging file frame systems, said corner comprising:

first boss means for receiving at least a portion of said frame, said first boss means defining a channel slidably penetrated by said frame portion to facilitate the longitudinal alteration of said frame;

second boss means for receiving at least a portion of said frame that is substantially perpendicular to said last mentioned frame portion; and, means for slidably coupling said first boss means to said second boss means to configure said file frame to receive hanging file folders of different sizes.

2. The corner as defined in claim 1 wherein one of said first boss means and said second boss means comprises an elongated, central slot, and the other of said first boss means and said second boss means comprises follower means for slidably fitting within said slot.

3. The corner as defined in claim 1 wherein said first boss means comprises an elongated, central slot, and said second boss means comprises elongated follower means slidably fitting within said slot.

4. The corner as defined in claim 1 including travel limiting means for preventing separation of said first boss means from said second boss means.

5. An adjustable hanging file frame, said frame comprising:

a pair of elongated rails having spaced apart ends, said rails adapted to be disposed in parallel, spaced apart relation;

a pair of cross member rods adapted to be disposed in parallel spaced apart relation to each other to brace said rails, said rods oriented generally perpendicularly to said rails;

a pair of spaced apart hoops projecting downwardly from said ends to contact a floor to support and elevate said frame; and, adjustable corner means for perpendicularly joining said rods and said hoops to said rails and maintaining said rods and hoops in spaced apart, generally coplanar relation, said corner means comprising:

first boss means for receiving at least a portion of said hoops and said rods;

second boss means for slidably receiving and temporarily securing at least a portion of said rails and maintaining said rails substantially perpendicular to said rods and hoops; and, means for slidably coupling said first boss means to said second boss means to configure said file frame for hanging file folders of different sizes.

6. The frame as defined in claim 5 wherein one of said boss means comprises an elongated, central slot, and the other of said boss means comprises follower means for slidably fitting within said slot.

7. The frame as defined in claim 5 wherein said first boss means comprises an elongated, central slot, and said second boss means comprises elongated follower means slidably fitting within said slot.

8. The frame as defined in claim 5 wherein said first boss means comprises a central, generally planar body comprising a slot and a minor boss integrally formed on each end of said body for receiving at least a portion of one of said rods and one of said hoops.

9. The frame as defined in claim 8 wherein said second boss means comprises a slider mated with said slot, said slider comprising an arm to be slidably received within said slot and a major boss integrally formed on an end of said arm for slidably receiving and securing at least a portion of one of said rails, said major boss oriented generally perpendicularly to said longitudinal axes of said minor bosses.

10. The frame as defined in claim 5 further comprising travel limiting means for preventing separation of said first boss means from said second boss means.

11. A hanging file frame adapted to be disposed within a drawer for slidably supporting hooked hanging file folders within a file containment area, said frame comprising:

a pair of elongated rails adapted to be disposed in parallel, spaced apart relation within said drawer to form opposite upper sides of said frame;

a pair of rods adapted to be disposed in parallel spaced apart relation to each other within said drawer to brace said rails, said rods oriented generally perpendicularly with respect to said rails;

a pair of hoops downwardly contacting a floor of said drawer to support and elevate said frame; and, four resilient corners associated with said frame for perpendicularly joining said rods and said hoops to said rails and maintaining said rods in spaced apart, generally coplanar relation with respect to said hoops, each corner comprising:

a central, generally planar body comprising a slot, a pair of minor bosses and a third minor boss integrally formed on said body for receiving said rods and said hoops, said pair of minor bosses having aligned and parallel longitudinal axes and common open exposed ends, said third minor boss having a vertically oriented axis relative to said pair of minor bosses; and, a slider mated within said slot, said slider comprising an arm slidably received within said slot and a major boss integrally formed on an end of said arm for slidably receiving and temporarily securing said rails to facilitate the longitudinal alteration of said containment area, said major boss oriented generally perpendicularly to said longitudinal axes of said pair of minor bosses.

12. The frame as defined in claim 11 wherein each of said major bosses contacts a wall of said drawer to maintain said frame rails in the proper spaced relationship.

13. The frame as defined in claim 12 wherein said slider further comprises a shoulder adjacent said major boss to act as a stop for said slider.

14. The frame as defined in claim 13 wherein said hoops comprise a generally horizontal foot integrally extending between two upright legs, each leg terminating in said tangs, and said tangs adapted to penetrate one of said pair of minor bosses on opposite sides of said frame.

15. The frame as defined in claim 14 wherein said tangs comprise a plurality of barbs for frictionally locking within said minor bosses.

* * * * *